United States Patent [19]

Zimmerman

[11] 4,311,185

[45] Jan. 19, 1982

[54] INJECTION PISTON FOR DIE CASTING

[75] Inventor: Rene Zimmerman, Bischofszell, Switzerland

[73] Assignee: Gebrueder Buehler AG, Switzerland

[21] Appl. No.: 58,189

[22] Filed: Jul. 17, 1979

[30] Foreign Application Priority Data

Jul. 19, 1978 [CH] Switzerland ..... 7813/78

[51] Int. Cl.[3] ..... B22D 17/10; B22D 17/20

[52] U.S. Cl. ..... 164/315; 164/312; 164/314

[58] Field of Search ..... 164/312, 313, 314, 315, 164/316, 317, 318, 113, 119, 120, 284; 425/135, 145, 567, 557; 92/174, 186, 181 R

[56] References Cited

U.S. PATENT DOCUMENTS 3,437,130 4/1969 Johnson et al. ..... 164/120 X 3,960,201 6/1976 Portalier ..... 164/312

*Primary Examiner*—Gus T. Hampilos

*Attorney, Agent, or Firm*—McGlew and Tuttle

[57] ABSTRACT

An injection piston for a die casting machine comprising, a piston die having a chamber therein open at one end, a die rod having an end slidable in the chamber for changing the volume thereof. A coolant is supplied to the chamber to act as a damper to the movement of the die rod toward the press die when the injection piston is moved under pressure into a mold. The coolant flows in a coolant path comprising a feed path defined in the die rod and a discharge path at least a portion of which is defined between the press die and the die rod and the rest of which is defined in the die rod. A slidably mounted immersion valve is in the end of the die rod adjacent the chamber and movable into a neutral, a first and a second position for selectively permitting the flow of coolant into and out of the chamber, blocking the flow of coolant altogether and permitting the flow of fluid only out of the chamber depending on the increase of pressure exerted on the injection piston as it is forced into a mold. A restraining member is biased toward the immersion valve for restraining its motion between its first and second operating positions.

22 Claims, 8 Drawing Figures

1
2
3
4
5
6
7
8
9
10
11
12
13
14
15
16
17
18
19
20
21
22
23
24
25
26
27
28
29
30
31
32
33
34
35
36
100
110
120
130
140

1
2
4
6
7
8
9
10
11
12
13
14
15
16
19
20
21
22
23
24
25
27
29
32
34
35
36
37
38
39
40

1
3
4
13
15
24
16'
44'
16
5
35
22
6
34
8
18
9
17
31
33
29
30
14
10
11
12
20
45
27
43
41
42
44
21
32
23
36
7
2

1
11
12
10
15
24
16
5
6
8
33
9
14
27
46
30
29
32
23
36
7
2

INJECTION PISTON FOR DIE CASTING

FIELD AND BACKGROUND OF THE INVENTION

The present invention relates in general to die casting machines and, in particular, to a new and useful injection piston construction having a press die and a die rod which are slidably mounted with each other and include a damping means therebetween for damping the motion of the press die as it is forcefully pushed into a mold.

In injection molding or die casting, the liquid metal is pressed at high speed with the injection piston during a so-called shot into the casting mold, to achieve a dood filling of the mold despite the progressive cooling of the casting material. At the end of the filling, the injection piston is abruptly braked by the incompressible casting material. The abrupt braking theoretically requires enormous accelerating forces, which produce high pressure peaks in the casting mold on the one hand, and in the driving system of the piston, on the other hand. These high pressure peaks exceed the closing force acting on the mold, so that keys are formed on the castings in the mold parting areas. The purpose of the present invention is to reduce the above mentioned pressure peaks at the end of a shot during the transition from filling pressure to end pressure.

SUMMARY OF THE INVENTION

This purpose is achieved according to the invention in that the press die is axially movable relative to the die rod and that the die rod is displaceable toward the press die by a pressure on the end face of the die press against the action of a hydraulic damping device.

An object of the present invention is to provide a die construction for a die casting machine comprising, a press die movable into a mold, a die rod slidably connected to the press die and movable to move the press die under pressure into the mold and hydraulic damping means connected between the press die and the die rod for damping a movement of the die rod toward the press die when the press die is moved under pressure into the mold.

A further object of the present invention is to provide an injection piston for a die casting machine comprising a press die having a chamber therein open at one end, a die rod having an end slidable in the chamber through the opening, the die rod movable to move the press die under pressure into a mold, the die rod defining a coolant feed path into the chamber for the passage of coolant at a working pressure and a coolant discharge path for the passage of coolant out of the chamber, an immersion valve removably mounted in the feed path which is exposed to the working pressure of the coolant on one side thereof and the pressure of the coolant in the chamber on the other side thereof, the immersion valve being in a neutral position for the passage of coolant through the feed and discharge path when the chamber is less than the working pressure and in a first operating position for the blockage of coolant in the feed and discharge paths when the chamber pressure is at least equal to the working pressure and in a second operating position for the passage of coolant out of the chamber only and through the discharge path when the chamber pressure exceeds the working pressure by a selected amount.

A futher object of the present invention is to provide a die construction or injection piston construction which is simple in design, rugged in construction and economical to manufacture.

The various features of novelty which characterize the invention are pointed out with particularity in the claims annexed to and forming a part of this disclosure. For a better understanding of this invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
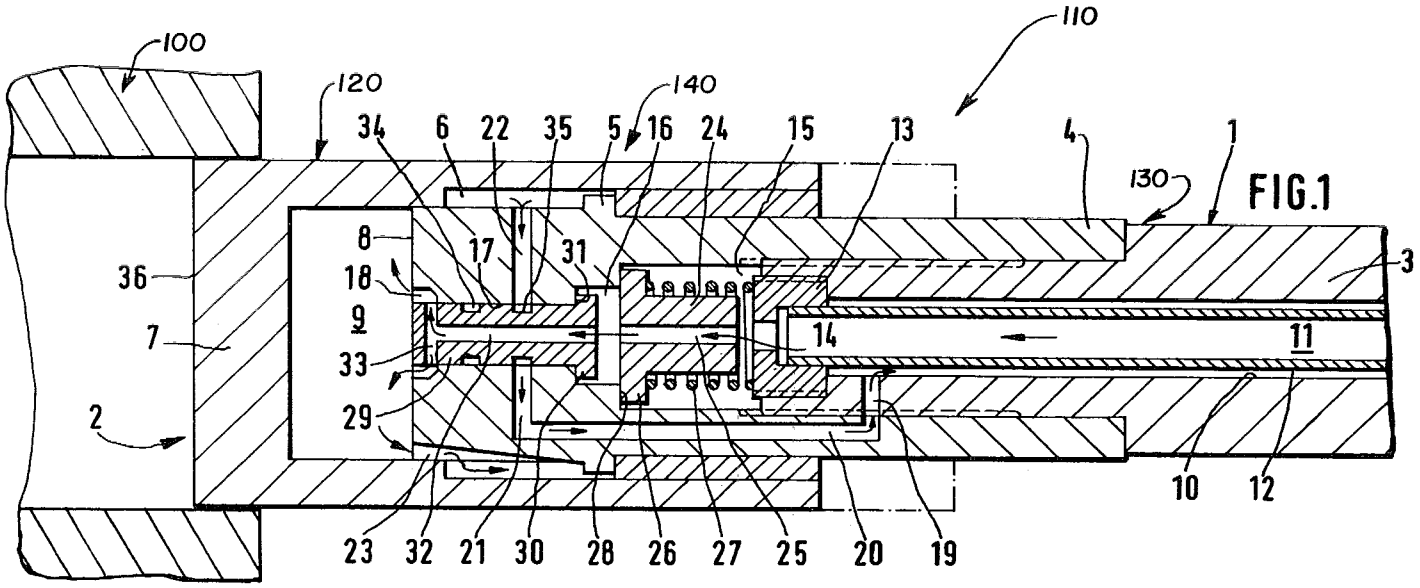
FIGS. 1 through 5 are sectional views of five separate embodiments of the press die and parts of the die rod in accordance with the invention.

Referring now to the drawings the invention embodied therein, in FIG. 1, comprises an injection piston or die construction generally designated 110 having a press die portion 120 which is slidably mounted to a die rod portion 130 with a hdyraulic damping means generally designated 140 connected therebetween.

Figure 8:
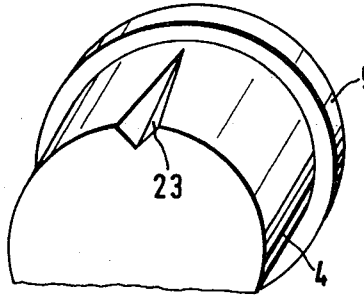
FIG. 8 is a front perspective view of a portion of the piston head connected to the die rod which is movable in the press die of FIGS. 1 through 4.

In FIG. 1, the die rod 1 is shown engaged with the press die 2. The die rod 1 has a shaft 3 on the end of which is screwed a piston head 4. Piston head 4 has an annular fin or flange 5 which engages an inside annular chamber 6 in press die 2 and prevents the press die from slipping off from die rod 1. Press die 2 is mounted on piston head 4 for axial displacement between two end positions, namely between the first end position indicated by solid lines and the second end position indicated by dot-dash lines. The right-hand or second end position of press die 2, indicated by dot-dash lines, is limited by end face 7 of the press die and end face 8 of piston head 4. In the first end position of press die 2, indicated by solid lines, it forms together with end face 8 of piston head 4, a chamber 9 whose volume varies between a maximum and minimum value during a displacement of press die 2 between the two end positions. Shaft 3 has an axial bore 10 in which is arranged a pipe 11 with a smaller diameter. The outside of pipe 11 forms together with bore 10 a channel 12 with a ring-shaped cross-section. The front end of pipe 11 is held tightly in a mount 13 which is screwed into the shaft end. Pipe 11 is adjoined by a bore 14 in the mount 13 which opens into a cylindrical chamber 15 in piston head 4. Cylindrical chamber 15 is adjoined by another cylindrical chamber 16 with a smaller diameter, which in turn communicates with a cylindrical bore 17. Bore 17 has a widening 18 facing chamber 9. Piston head 4 and shaft 3 are provided with channels 19 through 23, which together with annular chamber 6 form a coolant discharge pipe or path heading out from chamber 9. Channels 23, which connect chamber 9 with annular chamber 6, have the form of notched grooves whose cross-sectional flow decreases, preferably with the square of the displacement when press die 2 moves from its left-hand end position indicated by solid lines to the right into the end position indicated by dot-dash lines. These notched grooves 23 in combination with press die 2, thus form a throttle (FIG. 8) which is adjustable in dependence on the movement of the press die 2. A body or restraining member 24, with a central bore 25 is mounted for axial displacement in cylindrical chamber 15, which bears with a flange 26 on the one hand, against annular spring 27, and, on the other hand, against a shoulder 28 formed in head 4. An immersion slide valve 29 is slidably mounted in bore 17 for axial displacement, which bears, in the represented position with a flange 30, against a shoulder 31 of the head 4. Immersion slide valve 29 is provided with an axial bore 32, which opens into a branch 33 that connects bore 32 with widening 18 or chamber 9. On its outside surface, immersion slide valve 29 is provided with two annular grooves 34 and 35. In the represented position of the immersion slide valve, first annular groove 35 is opposite to and communicates with channels 21 and 22.

Figure 7:
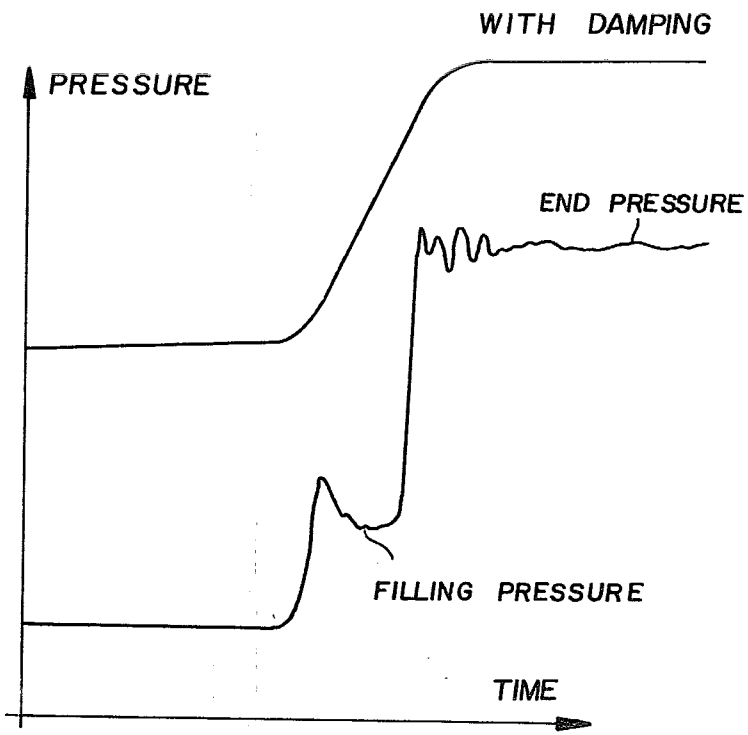
FIG. 7 is a graph similar to that shown in FIG. 6 of the characteristics of the inventive device.
Figure 6:
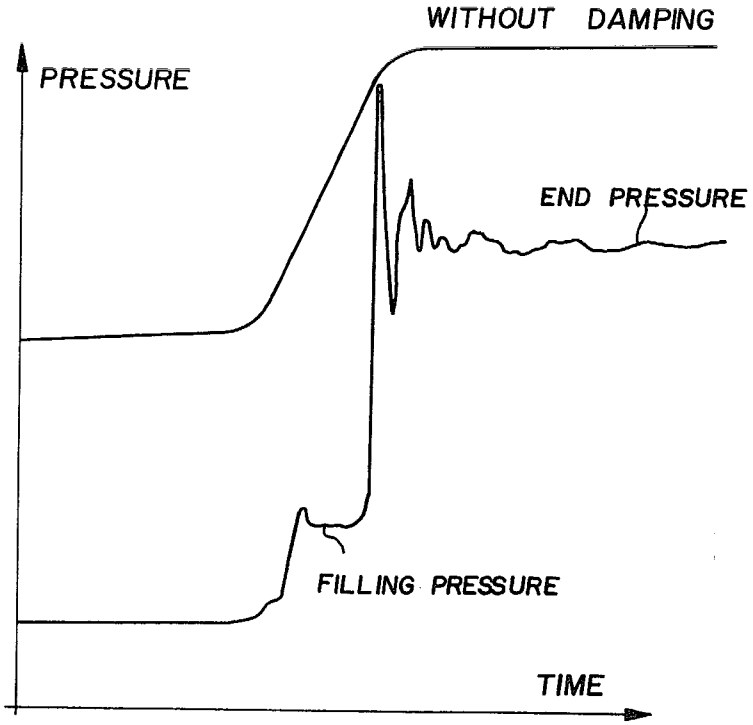
FIG. 6 is a graph showing the pressure exerted on the die plotted against time in prior art devices.

Cooling liquid for the press die 2 is fed through the feed pipe 11 to chamber 9 and then to press die 2. The overall feed line or path thus comprises, pipe 11, bore 14, cylindrical chamber 15, bore 25, cylindrical chamber 16, bore 32, branch 33 and widening 18, in order. With press die 2 unloaded, annular spring 27 presses body 24 against shoulders 28, and the cooling liquid pressure and flow keeps immersion slide valve 29 in the represented neutral position. When the die construction or injection piston is accelerated to fill a mold 100, that is at the start of a shot, the internal die pressure of the cooling liquid increases from the working pressure to the internal die filling pressure. When the internal die filling pressure exceeds the working pressure of the cooling liquid, it pushes immersion slide valve 29 to the right, until it reaches a first operating position in which it strikes against body or member 24. In this position of immersion slide valve 29, channels 21 and 22 are positioned between the two annular grooves 34 and 35, and branch 33 is between widening 18 on the one hand, and channels 21 and 22 on the other hand, so that the supply or feed of coolant and its discharge are both blocked. The cooling liquid trapped in chamber 9 opposes a relative displacement between press die 2 and die rod 1, since annular spring 27 is so provided that body 24 resists immersion slide valve 29 as long as the internal die filling pressure prevails in chamber 9. When the filling pressure acting on piston end face 36 of the press die 2 in the mold, rises to the end pressure, the pressure of the cooling liquid trapped in chamber 9 rises to the internal die filling pressure. Due to the pressure rise, immersion slide valve 29 is further displaced to the right together with body 24 against the action of spring 27 until body 24 strikes against mount 13. In this second operating position of immersion slide valve 29, second annular groove 34 is positioned opposite channels 21 and 22, so that the discharge of the cooling liquid from chamber 9 is open, while the feed through branch 33 remains closed. Die rod 1 can now be displaced further to the left. The effective cross-section of notch 23 decreases constantly and increasingly blocks the discharge of cooling liquid from chamber 9. The displacement movement of die rod 1 directed to the left is thus braked, so that end face 8 strikes end face 7 at a greatly reduced speed, preferably zero. The dimensions of notch 23 and thus the delay of the relative speed between press die and die rod are freely selectable, so that any desired damping effect can be achieved. As a comparison of FIGS. 6 and 7 shows, the injection piston according to the invention (FIG. 7) attains the end pressure with the same time delay as a conventional undamped injection piston, but without exceeding it markedly. When the die rod 1 is withdrawn after the shot, spring 27 and the cooling liquid pressure in pile 11 push body 24 and immersion slide valve 29 from the second operating position back into the neutral position shown in the drawing, so that the cooling liquid circuit is closed again. During the next shot the above described procedure is repeated.

Figure 2:
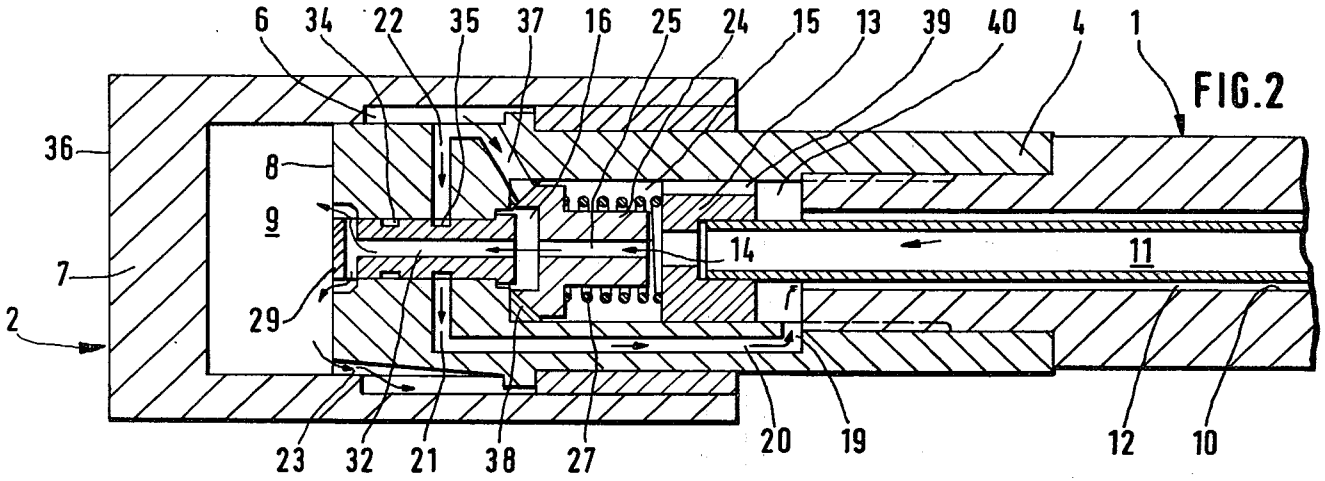

In the embodiment according to FIG. 2, the same parts as in the embodiment of FIG. 1 are provided with the same reference numerals. This embodiment differs from the first one in that additional channels 37 lead from annular chamber 6 through a ring 38 with an inner cone shape, into chamber 15, and from there through additional channels 39 into an annular chamber 40. Correspondingly, channel 12 adjoins annular chamber 40 in this embodiment. The discharge of cooling liquid to annular chamber 6 can thus take place here, not only through channel 22 and annular grooves 34, 35 as well as channels 21, 20 and 19, but additionally through channels 37 and 39, as well as chambers 15 and 40. Another difference is that body 24 has an outer cone shape corresponding to the inner cone shape of ring 38, which adjoins channels 37 in the represented neutral position. When immersion slide valve 29 is displaced during a shot into the first operating position under the prevailing internal die filling pressure, provided it exceeds the working pressure of the coolant, channels 37 remain closed by body 24. Only by a further pressure rise to the internal die filling pressure is the existing discharge of the cooling liquid from annular chamber 6 through channels 19 to 22 supplemented by channels 37 and 39. This embodiment has the advantage that, when the pressure rises in chamber 9 from the internal die filling pressure to the internal die pressure, the discharge of the cooling liquid through channels 37 and 38 starts without delay.

Figure 3:
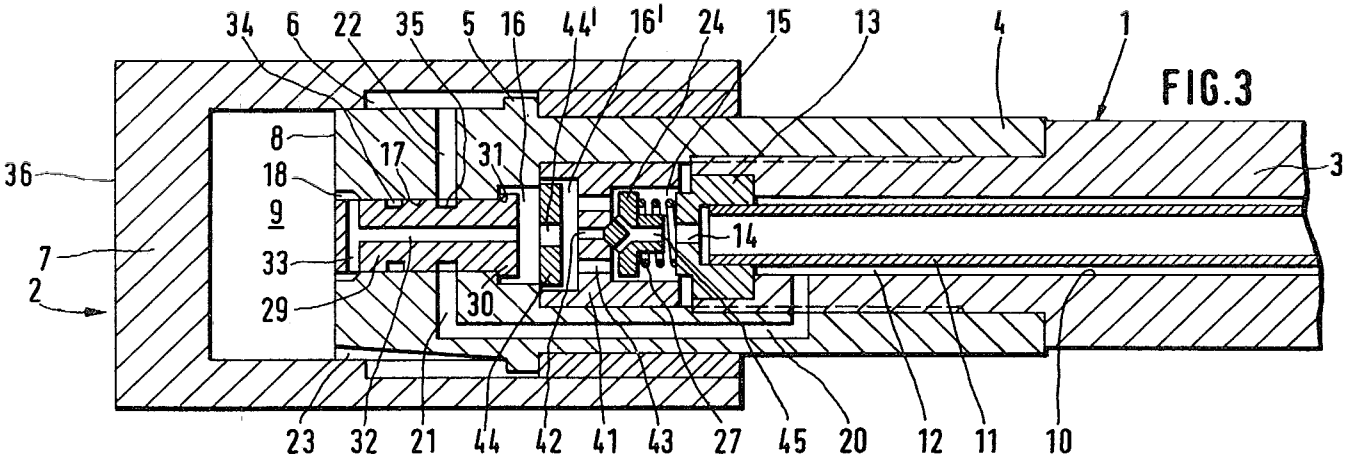

In the embodiment according to FIG. 3, the same or equivalent parts have been provided with the same reference numerals as in the embodiment according to FIGS. 1. In contrast to the first embodiment, chambers 15 and 16 are separated here by a wall 41. Wall 41 has a central bore 42, as well as additional bores 43, which connect the two chambers 15 and 16 with each other. Furthermore, chamber 16 has a cylindrical widening 16', in which an annular disc 44 is mounted for axial displacement, whose central bore 44' is aligned with central bore 42 of wall 41. Annular disc 44 is axially displaceable between two end positions. In the end position indicated in the drawing by solid lines, annular disc 44 bears against the left end of widening 16' and in the other end position against wall 41, and closes bores 43. Body 24 closes central bore 42 under the action of spring 27. Body or restraining member 24 is provided on the side facing pipe 11 with a blind bore 45 from which small bores lead radially to bores 43. In the operating position of press die 2 shown in the drawing, the cooling medium flows from pipe 11 through bore 14 into chamber 15, and from there through bore 45 and the unnumbered radial bores to bore 43, and from there through bore 44' to chamber 16. From chamber 16 the cooling liquid flows through bore 32 and branch 33 into chamber 9. When press die 2 is admitted with the filling pressure during a shot, immersion slide valve 29 is displaced to the right, provided the internal die filling pressure, and thus the chamber 9 pressure, exceeds the cooling liquid pressure, and at the same time annular disc 44 is displaced to the right toward wall 41 and closes bores 43. The coolant trapped in chamber 16 between body 24 and immersion slide valve 29 forms a hydraulic stop which keeps immersion slide valve 29 in the first operating position. In this operating position, it blocks the supply and discharge of coolant. If the internal die filling pressure does not exceed the coolant pressure in chamber 9 during a shot, immersion slide valve 29 and annular disc 44 remain in place. Only when the pressure acting on injection piston 2 rises from the filling pressure to the end pressure is immersion slide valve 29 displaced to the right, and increases the pressure in chamber 16 until spring-loaded body 24 clears central bore 42 and the coolant can return from chamber 16 to pipe 11. Immersion slide valve 29 can thus be displaced further to the right until it strikes against annular discs 44, so that the discharge for the coolant is opened. This embodiment has principally the same damping characteristic as that of FIG. 1, but it has the advantage that spring 27 can be much thinner than in the embodiment of FIG. 1.

Figure 4:
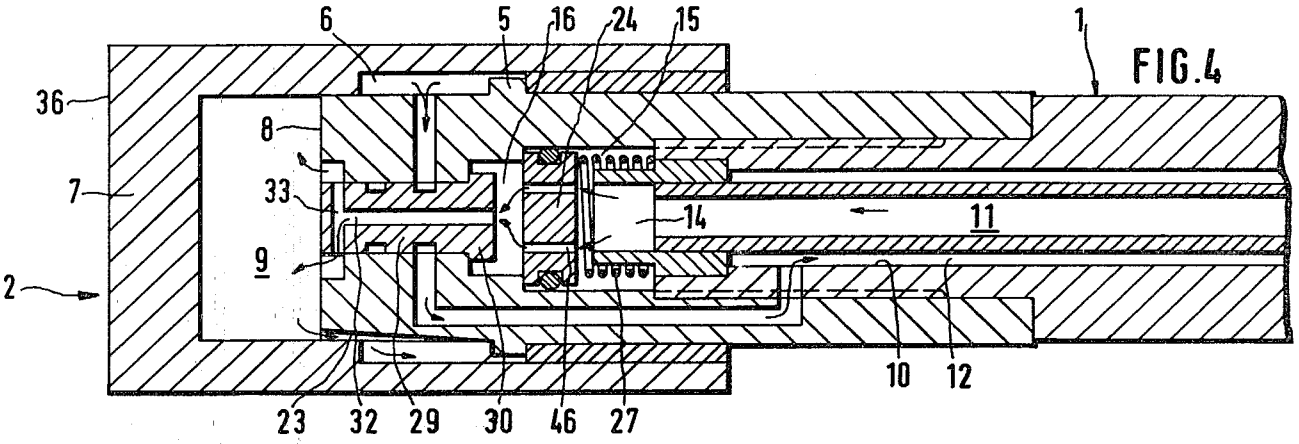

In the embodiment according to FIG. 4, parts corresponding to the embodiment in FIG. 1 have been provided with the same reference numbers. In contrast to FIG. 1, body 24 in FIG. 4 has here bores 46 which are closed by immersion slide valve 29 when the latter is displaced to the right into the first operating position. The force exerted by spring 27 on body 24 thus acts additionally on the coolant pressure in pipe 11. Spring 27 thus only has to be made so that it can withstand, together with the coolant pressure acting on body 24, the force exerted by the internal die filling pressure on immersion slide valve 29. Spring 27 has principally only a restoring function. Only when the cooling liquid trapped in chamber 9 undergoes an additional pressure rise by the rise of the pressure from the internal die filling pressure to the internal end filling pressure, is immersion slide valve 29 displaced together with body 24 to the right against the coolant pressure until body 24 strikes against mount 13. In this second operating position, immersion slide valve 29 releases the discharge of cooling liquid from chamber 9, so that die rod 1 can be displaced further to the left and throttle the discharge of cooling liquid increasingly until end face 8 strikes end face 7.

In all embodiments according to FIGS. 1 to 4, additional throttle elements (not shown) are arranged in the discharge lines.

The hydraulic damping means thus provided between the press die 2 and the die rod 1 comprises a hydraulic fluid supply conduit which supplies hydraulic fluid to the chamber 9 between the press die and die rod, and a hydraulic fluid outlet formed, for example, by notch 23 and annular chamber 6. The hydraulic fluid outlet conduit has a decreasing cross-sectional area with a decrease in the volume of the chamber 9 to achieve a smooth damping effect.

Figure 5:
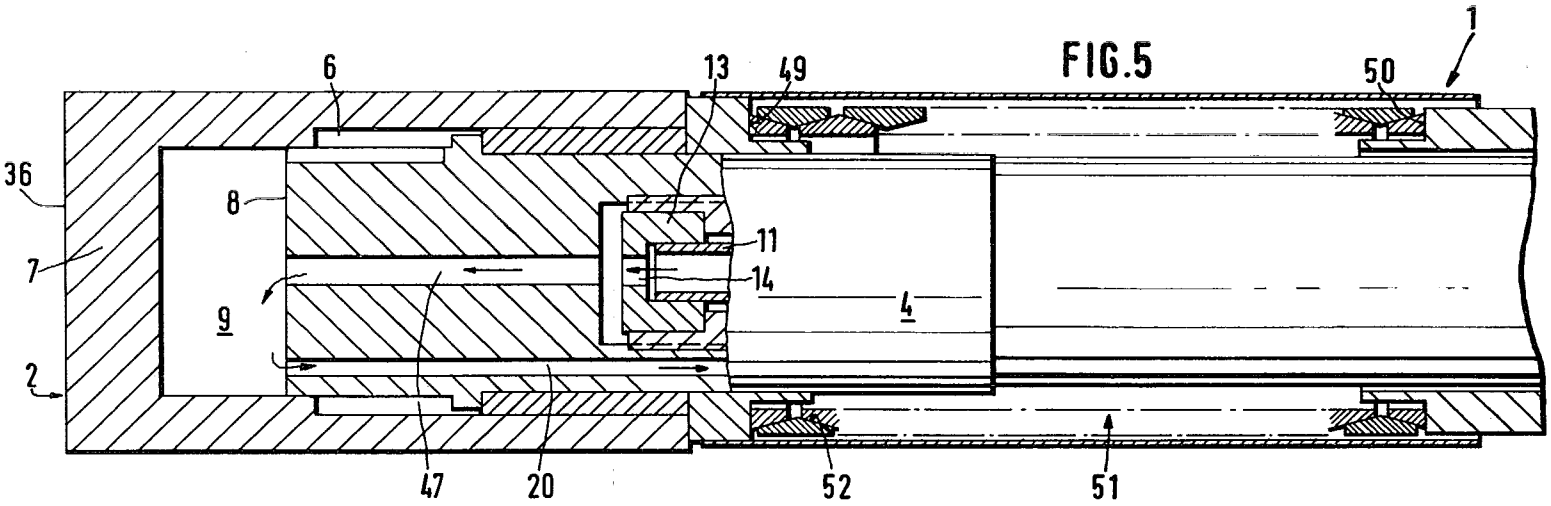

In the embodiment according to FIG. 5, the parts corresponding to the embodiment according to FIG. 1 have been provided with the same reference numerals. In this embodiment no immersion slide valve is provided in the coolant circuit. A cooling liquid flows from pipe 11 through bore 14 into an adjoining bore 47 which axially traverses piston head 4. Bore 47 opens into chamber 9, from which the cooling liquid flows through channel 20, which is open toward chamber 9. Press die 2 has a ring shoulder 49 opposite a ring shoulder 50 on die rod 1. Between the two ring shoulders 49 and 50 are provided annular springs which damp a relative movement of press die 2 toward tie rod 1. The individual rings of annular springs 41 overlap and contact each other with corresponding wedge-shaped flanks 52. Under a force acting on end face 36 of injection piston 2, annular springs 51 are pushed toward each other. Due to the wedge-shaped flanks 52, the individual annular springs are alternately upset tangentially or expanded tangentially, and relax again when press die 2 is relieved. Prior to a shot, the coolant pressure in chamber 9 keeps pressure die 2 in the left end position shown in the drawing. With the start of the shot, the pressure acting on end face 36 rises to the filling pressure and then to the end pressure, with die rod 1 being displaced gradually to the left corresponding to the rising pressure against the coolant pressure in chamber 9 and against the action of annular springs 51. The pressure peaks appearing in the transition from filling pressure to end pressure are damped partly by the cooling liquid and partly by annular springs 51. The damping action of the cooling system is influenced by the adjustable throttles and/or pressure relief valves in the feed and discharge pipe line.

While specific embodiments of the invention have been shown and described in detail to illustrate the application of the principles of the invention, it will be understood that the invention may be embodied otherwise without departing from such principles.

What is claimed is:

1. An injection piston in a die casting machine comprising, a press die having interior walls defining a chamber therein open at one end, a die rod having an end slidable in said chamber through said open end thereof, said die rod movable to move said press die under pressure into a mold, said die rod defining a coolant feed path into said chamber for the passage of coolant at a working pressure and a coolant discharge path for the passage of coolant out of said chamber, an immersion valve movably mounted in said feed path which is exposed to said working pressure of the coolant on one side and a pressure of coolant in said chamber on another side thereof, said immersion valve being in a neutral position for the passage of coolant through said feed and discharge paths when said chamber pressure in less than said working pressure, and in a first operating position for the blockage of coolant in said feed and discharge paths when said chamber pressure at least equals said working pressure and in a second operating position for the passage of coolant in said discharge path but not in said feed path when said chamber pressure exceeds said working pressure by a selected amount, and restraining means engaged with said immersion valve when it is in said first operating position for restraining said immersion valve from moving to said second operating position until said selected amount is reached.

2. An injection piston according to claim 1, wherein said discharge path is formed by means defining an inside annular chamber defined between said press die and said die rod, means defining a throttle portion of said discharge path communicating said chamber with said inside annular portion, said immersion valve slidable in means defining an enlarged portion of said feed path, means defining a first channel portion extending from said inside annular chamber to said enlarged portion of said feed path and a second channel portion extending from said enlarged portion of said feed path, said immersion valve including first and second annular grooves defined thereon, said first annular groove communicating said first and second channel portions with said immersion valve in said neutral position, said second annular groove communicating said first and second channel portions with said immersion valve in said second operating position and the flow of coolant between said first and second channel portions blocked with said immersion valve in said first operating position.

3. An injection pistion according to claim 1, further including means defining a bore extending axially through said die rod, a pipe having a smaller diameter than said die rod bore extending into said die rod bore and defining an annular channel therewith, the interior of said pipe forming a portion of said feed path and said annular chamber forming a portion of said discharge path.

4. An injection piston according to claim 1, wherein said throttle portion decreases the flow of coolant out of said chamber in proportion to the square of displacement of said die rod into said chamber.

5. An injection piston according to claim 1, wherein said die rod includes a piston head connected thereto and slidable in said press die chamber, said piston head having a face facing said chamber, said chamber having a maximum volume at a first position of said press die when said working pressure is at least equal to said chamber pressure, and a minimum volume when said press die is at a second position, said discharge path including a throttle portion for increasingly resisting the flow of coolant from said chamber as said chamber changes in volume from said maximum volume to said minimum volume.

6. An injection piston according to claim 5, wherein said throttle portion comprises means defining a notched groove defined in said piston head, said discharge path formed by an inside annular chamber defined between said press die and said piston head communicating with said notched groove, the cross-sectional flow area through said notched groove into said inside annular chamber decreasing with the movement of said piston head into said chamber.

7. An injection piston according to claim 5, wherein said immersion valve is slidably mounted in an enlarged portion of said feed path, said enlarged portion extending through said end face of said piston head, said piston head having an opening on said end face communicating with said enlarged portion, said immersion valve including a channel therethrough which communicates with said widening and into said chamber with said immersion valve in said neutral position and closed with respect to said widening with said immersion valve in said first and second operating positions.

8. An injection piston according to claim 1, wherein said restraining means comprises a restraining member slidably mounted in said feed path upstream of said slidably mounted immersion valve, a spring biasing said restraining member in the direction of said immersion valve.

9. An injection piston according to claim 8, wherein said restraining member includes means defining at least one bore for the passage of coolant, said immersion valve closing said bore in said first operating position thereof.

10. An injection piston according to claim 8, further including a wall across said feed path between said immersion valve and said restraining member having a central bore, said restraining member closing said central bore with said immersion valve in said first position said wall having at least one additional bore for the passage of coolant, said restraining member having a bore communicating with said additional bore for the passage of coolant, a disc across said feed path movable between said wall and said immersion valve having a bore therethrough aligned with said centrol bore of said wall, said disc movable toward said wall for closing said additional bore with said immersion valve in said first operating position for closing the passage of coolant through said additional bore, said restraining member movable to open said central bore of said wall with said immersion valve in said second operating position to permit the flow of coolant directly from between said disc and said immersion valve into said pipe extending through said die rod bore.

11. An injection piston according to claim 8, wherein said restraining member is slidable in an enlarged portion of said feed path, said discharge path formed by means defining a channel communicating said annular chamber with said enlarged portion of said feed path.

12. An injection piston according to claim 11, wherein said channel is closed by said restraining member with said immersion valve in said neutral and first operating position and opens said channel with said immersion valve in said second operating position.

13. A die construction for a die casting machine comprising, a press die movable into a mold, a die rod slidably connected to said press die and movable to move said press die under pressure into said mold, hydraulic damping means connected between said press die and said die rod for damping a movement of said die rod toward said press die when said press die is slowed down by a backpressure acting on its pressure surface, and a cooling liquid circuit for providing coolant through said die rod and to said press die, said coolant comprising a hydraulic medium for said hydraulic damping means, said cooling liquid circuit comprises means defining a coolant feed path in said die rod, said press die having internal walls defining a chamber with said die rod slidable in said chamber to change the volume thereof, said feed path communicating with said chamber and including an enlarged diameter portion, an immersion valve slidably mounted in said large diameter portion of said feed path having a channel defined therethrough communicating said feed path with said chamber, said die rod having an end face facing said chamber with an opening therein, said immersion valve slidable in said opening and movable from a neutral position for the flow of coolant through said feed path and into said chamber to a first operating position with said immersion valve channel closed when a coolant pressure in said chamber is at least equal to a working pressure of said coolant in said feed path.

14. A die construction according to claim 13, further including means defining a discharge path from said chamber defined at least in part in said die rod, said discharge path including a throttle portion for decreasing the flow of coolant out of said chamber as the volume thereof reduces due to the movement of said die rod progressively into said chamber, whereby the movement of said press die with respect to said die rod is progressively increasingly damp until the volume of said chamber reaches zero, the damping is at its maximum value.

15. A die construction according to claim 14, wherein said throttle portion comprises a notched groove in said die rod adjacent said chamber, said chamber including an enlarged diameter portion forming with said die rod an inside annular chamber communicating with said notched groove.

16. A die construction according to claim 15, further including means defining a first radial channel portion extending from said inside annular chamber to said enlarged diameter portion of said feed path, means defining a second radial channel portion extending out from said large diameter portion of said feed path, said immersion valve having first and second annular grooves defined on the outer surface thereof, said first annular groove communicating said first and second radial channel portions with said immersion valve in said neutral and closing the communication between said first and second radial channel portions with said immersion valve in said first operating position, said notched groove, inside annular chamber, and first and second radial channel portions comprising said discharge path.

17. A die construction according to claim 16, further including restraining means engaged with said immersion valve in its first operating position, said immersion valve moving to a second operating position against the restraint of said restraining means when the coolant pressure in said chamber rises above the working pressure of the coolant by a selected amount, said second annular groove communicating said first and second radial channel portions when said immersion valve is in said second operating position to open the flow of fluid from said chamber to said discharge feed.

18. A die construction according to claim 17, wherein said restraining means comprises a restraining member slidably mounted in said feed path upstream of said slidably mounted immersion valve, and a spring engaged with said restraining member biasing it in the direction of said immersion valve.

19. A die construction according to claim 18, further including means defining an additional radial channel extending from said inside annular chamber to a second enlarged diameter portion of said feed path in which said restraining member is slidably mounted, said restraining member closing the flow of coolant in said additional radial channel with said immersion valve in its neutral or first operating position and opening the flow of coolant in said additional radial channel with said immersion valve in said second operating position.

20. A die construction according to claim 18, further including a disc movable in the flow direction of said coolant in said feed path between said immersion valve and restraining member, said disc having a bore defined therethrough, a wall across said feed path between said disc and said restraining member having a central bore defined therethrough closed by said restraining member by the bias of said spring and additional bores defined therethrough spaced from said central bore, said disc movable to close said additional bores with said immersion valve in said first operating position to block the flow of coolant in said feed path and said restraining member movable to open said central bore to permit the passage of coolant directly from said feed path to said discharge path with said immersion valve in said second operating position.

21. A die construction according to claim 18, wherein said restraining member has at least one bore defined therethrough, positioned so that said immersion valve closes said bore through said restraining member when said immersion valve is in said first operating position to block the flow of coolant through said restraining member bore.

22. A die construction for a die casting machine comprising, a press die movable into a mold cavity, a die rod slidably connected to said press die and defining with interior walls of said press die a hydraulic fluid chamber, said die rod movable to move said press die under pressure into said mold, hydraulic damping means connected between said press die and said die rod for damping a movement of said die rod towards said press die when said press die is slowed down by a back pressure acting on said press die, said hydraulic damping means comprising means defining a hydraulic fluid supply conduit in said die rod to said chamber and means defining a hydraulic fluid outlet conduit in said die rod from said chamber, said chamber being closed to said mold cavity, said chamber decreasing in volume when said die rod is moved to apply pressure to move said press die, said reduction in volume forcing hydraulic fluid out through said hydraulic fluid outlet conduit to damp the movement of said die rod toward said press die, said hydraulic fluid outlet conduit including a portion defined between said die rod and press die which is varied in cross-sectional area, with the cross-sectional area of said hydraulic fluid outlet conduit reducing with reduced volume of said chamber to increase a resistance to flow of hydraulic fluid in said hydraulic fluid outlet conduit, said hydraulic fluid supply conduit, said hydraulic fluid outlet conduit and said chamber form a cooling liquid circuit for providing coolant through said die rod and to said press die, said coolant comprising a hydraulic medium for said hydraulic damping means.

* * * * *